US005129323A

United States Patent [19]

Park

[11] Patent Number: 5,129,323

[45] Date of Patent: Jul. 14, 1992

[54] RADAR-AND INFRARED DETECTABLE STRUCTURAL SIMULATION DECOY

[75] Inventor: George B. Park, Trumbull, Conn.

[73] Assignee: American Cyanamid Company, Stamford, Conn.

[21] Appl. No.: 563,903

[22] Filed: May 24, 1991

[51] Int. Cl.[5] ..... F42B 4/18

[52] U.S. Cl. ..... 102/293; 89/1.11; 342/10

[58] Field of Search ..... 102/336, 342, 355, 505, 102/293; 89/1.11; 342/8-10

[56] References Cited

U.S. PATENT DOCUMENTS

| | | | |
|---|---|---|---|
| 3,204,239 | 8/1965 | Young | 342/10 |
| 3,837,281 | 9/1974 | Shaffer et al. | 102/336 |
| 4,069,762 | 1/1978 | Maury | 89/1.11 |
| 4,171,669 | 10/1979 | Allen | 102/342 |
| 4,222,306 | 9/1980 | Maury | 102/505 |
| 4,307,665 | 12/1981 | Block et al. | 102/505 |
| 4,454,816 | 6/1984 | Billard et al. | 102/342 |

*Primary Examiner*—Charles T. Jordan
*Attorney, Agent, or Firm*—Frank M. Van Riet

[57] ABSTRACT

A simulation decoy whose position and structural purport are determinable by infrared detection means is disclosed, which comprises a multi-dimensional display body containing a sufficient quantity of combustible carbon to provide a controlled burning for a predetermined length of time, means to initiate ignition of said carbon to produce sustained burning of said multi-dimentionsal display body to activate such simulation decoy for infrared detection, and specific metal coated fibers to provide radar-detection capability. It may be utilized to mimic mobile structures such as land-based vehicles, marine vehicles, or aircraft, as a two-dimensional or three-dimensional display, providing an infrared and radar signature useful as a defensive countermeasure in warfare or other battlefield conditions. In one embodiment, the multi-dimensional display body is provided as an inflatable spherical body which can be discharged from an aircraft at high altitudes and employed to provide a spherical radar and infrared signature, to provide a defense countermeasure against "smart" heat-seeking, surface-to-air and air-to-air guided missiles.

39 Claims, 5 Drawing Sheets

RADAR-AND INFRARED DETECTABLE STRUCTURAL SIMULATION DECOY

BACKGROUND OF THE INVENTION

1. Cross Reference to Related Applications

This application is related to commonly assigned U.S. patent application Ser. No. 629,860 filed Jul., 11, 1984.

2. Field of the Invention

This invention relates generally to improved simulation decoys useful in radar- and infrared-detection environments. More specifically, the invention relates to military defensive countermeasure systems, having utility as decoys for aircraft, ships, tanks, and other military targets under battlefield or warfare conditions.

3. Description of the Prior Art

In the practice of modern warfare, a variety of missiles have come into use which employ sensing means, such as radar and/or infrared detection means to determine the position and structure of potential targets, e.g., land-based vehicles, ships, and aircraft. Examples of such missiles include the "Sidewinder" heat-seeking missile, employed in air-to-air combat and the more recently developed French Exocet missile, which is radar-guided. The Exocet missile was used successfully in the Falklands war between Argentina and Great Britain as an anti-ship missile.

With regard to infrared-sensing devices employed in such missiles, it has been common practice to employ various decoy means, which burn or otherwise emit infrared radiation in use, such means being launched or otherwise deployed to provide a positional and structural perception by the detection means of an intended target. Such decoys provide means for aircraft, land-based vehicles or ships to elude the infrared-guided weapons.

Decoy systems of the aforementioned type are disclosed in U.S. Pat. No. 4,222,306 (a multiple decoy launching unit), U.S. Pat. No. 4,307,665 (same), U.S. Pat. No. 4,171,669 (a decoy flare cartridge containing a charge of jelled hydrocarbon fuel), French Patent No. 2,490,333 (a projectile containing explosives, such as material producing a flare or an infrared decoy), and U.S. Pat. No. 4,069,762 (an emissive decoy comprising an ignitable pyrotechnic composition, the ignition of which forms a cloud of droplets of aerosol from a liquid aerosol in a separate compartment of the decoy). Great Britain Patent No. 2,121,148 discloses a guided missile radar decoy comprising a metal-coated balloon which is inflated by compressed air, it being taught that several such balloons coupled together produce a reflection similar to that of a ship. Specifically, the balloons may be set up in "V" configuration to simulate a ship and thereby decoy radar-guided missiles.

A particular problem with infrared decoys of the prior art (e.g., parachute or projectile flares) is that modern infrared detection means have become sufficiently accurate insofar as their resolution characteristics are concerned to differentiate true targets from these previously effective decoys. Such infrared detection means as currently employed can differentiate a 1% change in temperature and thus can accurately resolve and differentiate such decoy means from the temperature and size profile of the actual target—a jet engine or missile exhaust, or a tank and its occupants. True and accurate thermal profiles of the actual target can be programmed in the control apparatus of the missile such that its infrared detection means "look" for the programmed thermal structure, e.g., of an engine block and cooling system network in a tank and thus are not confused by conventional infrared decoy displays.

In response thereto, the invention embodied in above-mentioned U.S. Ser. No. 629,860 was developed. This decoy comprises combustible carbon to provide the decoy with an infrared signature and a means of initiating the ignition of the carbon. Optionally, the decoy comprises metal-coated fibers to further provide an enhanced radar signature to the decoy. However, metal-coated fibers are subject to accelerated degradation at high temperatures. Incorporation of metal-coated fibers into the decoy therefore limited the temperature at which the decoy could be operated without loss of its structural integrity and/or enhanced radar signature.

Accordingly, there is a continuing need in the field of military countermeasures for a simulation decoy which can accurately mimic the thermal structure of an intended target and thus foil the aforementioned high resolution infrared detection means. In addition, because such infrared detection means are frequently coupled with radar detection means or used as an adjunct to an initial radar sighting which then is subjected to IR scanning to determine the precise nature of the radar detection, there is likewise a need for an improved infrared decoy of the aforementioned type which likewise accurately simulates the radar signature of an intended target. However, such objectives should be able to be accomplished at highly elevated temperatures while avoiding compromising the structure of the decoy and therefore its radar capabilities as well as the full infrared capabilities of the decoy.

It therefore is an object of the present invention to provide an improved simulation decoy whose position and structural purport (i.e., what the structure appears to be) are determinable by infrared detection means in combination with infrared detection means.

SUMMARY OF THE INVENTION

This invention relates to a simulation decoy whose position and structural purport are determinable by infrared detection means comprising:

(a) a multi-dimensional display body formed of fabric containing combustible carbon in the form of fibers or particles, such combustible carbon being present in the fabric in an amount and with a surface area sufficient to permit sustained burning of said fabric for a predetermined time;

(b) means to initiate ignition of said combustible carbon in said multi-dimensional display body fabric for sustained burning of said multidimensional display body, whereby said simulation decoy is activated for infrared detection; and (c) metal-coated fibers comprising a protective NiW or CoW alloy barrier interposed between the fiber and its metal coating.

In a preferred embodiment, the fabric in the multi-dimensional display body comprises a composite material selected from the group consisting of:

(i) activated carbon fibers having a BET surface area in the range of from about 250 to about 1,000 meters$^2$/gram, reinforced with a reinforcingly effective amount of a non-ignitable binder fiber;

(ii) particulate carbon of diameter in the range of from about 10 $\mu$m to about 500 $\mu$m encapsulated in a matrix of non-ignitable binder fibers; and (iii) mixtures of (i) and (ii).

The aforementioned non-ignitable binder fibers may suitably comprise a low surface area carbon or preoxidized carbon, i.e., a carbon or preoxidized carbon having a BET surface area substantially less than about 250 $m^2/g$. Other non-ignitable binder fibers such as NOMEX, and KEVLAR, also may be used.

To impart radar simulation decoy characteristics to the aforementioned multi-dimensional display body, specific metal-coated fibers are utilized. Such fibers are characterized by the presence of a layer of CoW or NiW alloy interposed between the fiber core and the outer metallic layer.

In one particularly preferred embodiment, the means to produce sustained burning of said multidimensional display body comprise a source of oxygen-containing gas and a combustion catalyst providing for the initiation of ignition of the combustible carbon, upon exposure thereof to ambient conditions.

DETAILED DESCRIPTION OF THE PREFERRED EMBODIMENTS

Figure 1:
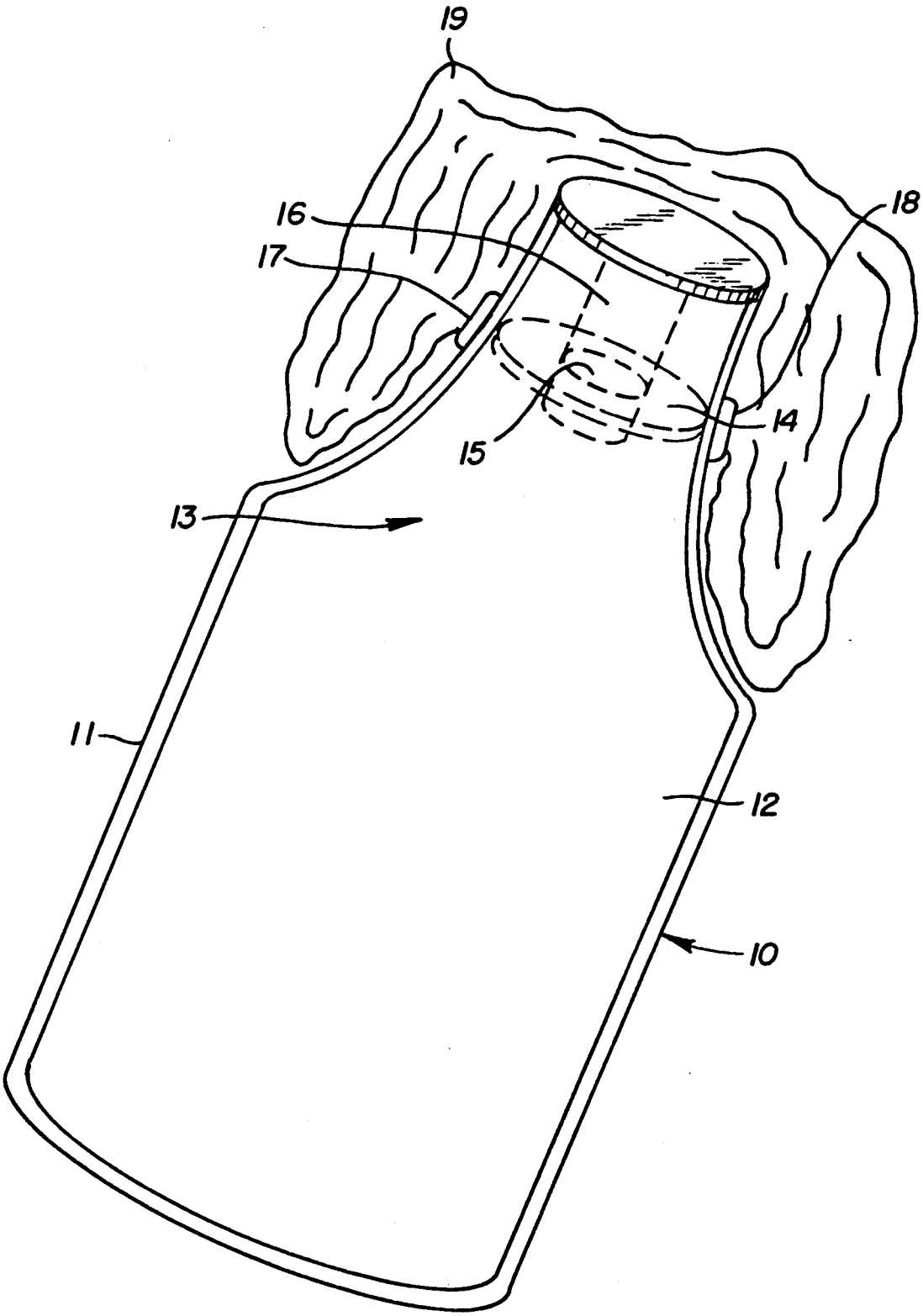
FIG. 1 is an infrared decoy according to the present invention, in the form of an inflatable balloon-like structure featuring an oxygen-containing gas supply means which may be employed to provide a spherical display for infrared, or infrared and radar detection.

The simulation decoy of the present invention comprises a multi-dimensional display body formed of an ignitable fabric of controllable burning characteristic, the fabric comprising sufficient content of combustible carbon to provide the desired infrared "signature." As used herein, the term "multi-dimensional" in reference to the display body indicates that the display body provides a two- or three-dimensional depiction whose position and structural purport are determinable by infrared detection means. Suitably, the carbon content of the fabric may be constituted by activated carbon fibers of high surface area, e.g., in the range of from about 250 to about 1,000 $m^2/g$ in a structural matrix which comprises a reinforcingly effective amount of a non-ignitable (non-combustible) binder fiber, to provide the activated carbon fiber matrix with sufficient mechanical strength to retain its structural integrity during use. Alternatively, or in addition to the aforementioned high surface area activated carbon fibers, the carbon content of the ignitable fabric may be constituted by particulate activated carbon having a diameter in the range of from about 10 $\mu m$ to about 500 $\mu m$. The carbon particles may be encapsulated in a matrix of nonignitable binder fibers or other structural matrix material, again to provide sufficient strength and mechanical integrity for use conditions.

In order to impart improved radar signature characteristics to the multi-dimensional display body described above, metal-coated fibers are utilized which have a layer of NiW or CoW alloy interposed between the fiber core and the outer layer which is a suitable radar-reflective metal (e.g., nickel, copper or iron, with nickel generally being preferred). Optionally, additional metal coating may be present on other carbon fibers or particles, activated carbon particles, reinforcing binder fibers and/or mixtures thereof employed in the ignitable fabric. It is further advantageous to provide such metal coated fibers, when fibers are employed as the form of the carbon, in differing lengths to provide strong reflection of radar signals. For example, it may be advantageous to provide metal coated carbon fibers of diameter in the range of from about 4 $\mu m$ to about 40 $\mu m$ and length in the range of from about 1 mm to about 30 mm with fibers of such length comprising preferably between about 10% and 40% by weight, based on the weight of the fabric in which such metal-coated fibers are deployed.

The ignitable and combustible carbon fiber or carbon particles employed as the combustible carbon component of the fabric in the multi-dimensional display body should have a surface area preferably greater than 250 $m^2/g$, e.g. in the range of from about 250 to about 1,000 $m^2/g$. Below the lower limit of about 250 $m^2/g$, there is too little surface area provided for effective combustion in use, and above about 1,000 $m^2/g$, the strength of the carbon fibers or particles is reduced, and the decoy becomes significantly more expensive, without corresponding level of improvement in the performance of the decoy.

Where carbon fibers are employed as the morphology for the combustible carbon component of the fabric for the multi-dimensional display body, the fibers may be employed in woven or non-woven matrices, in which it generally is desirable to employ a binder fiber which is non-combustible in character, for retention of the structural integrity of the fiber matrix and fabric forming the display body during its use. A suitable binder fiber may comprise carbon fibers of low surface area (carbonized carbon fiber) having a BET surface area of less than about 25 $m^2/g$. Also suitable for use as reinforcing binder fibers are fibrillated polytetrafluoroethylene, KEVLAR® and NOMEX® fibers.

In some applications of the present invention, it may be necessary or desirable to provide for initiation of ignition of the combustible carbon constituent in the display body by incorporation of a catalyst component in the fabric matrix. Thus, oxidation catalyst materials, such as chromium, silver, copper, and iron, may be deposited or otherwise coated on the combustible carbon surface to facilitate burning of the fabric. Generally, the loading levels for the metallic catalyst will range from about ½ weight percent to about 5 weight percent, based on the weight of the combustible carbon coated with the metal. The metal catalyst may be applied to the substrate carbon by any conventionally employed means, such as liquid phase precipitation, vapor phase precipitation, liquid phase deposition, and vapor phase deposition. It is preferred in practice to employ a liquid phase deposition of the salt of the metal catalyst, followed by thermal decomposition of the salt to yield the metal in a reduced state and for such purpose the thermal decomposition step is suitably carried out under a reducing atmosphere. Nonetheless, the specific method employed to deposit the metal on the carbon substrate forms no part of the present invention, and any suitable method known to those of ordinary skill in the art may be usefully employed.

As mentioned, the combustible carbon content of the fabric employed in the simulation decoy of the present invention will usually lie in the range of from about 50% to about 85% by weight, based on the weight of the fabric. At levels below 50% by weight, insufficient combustible carbon is provided with the result that the utility life of the decoy is unsuitably short. On the other hand, at weight percent levels above 85% combustible carbon, the physical character of the decoy is adversely affected, since insufficient reinforcement or other material is provided to maintain the structural integrity of the decoy.

The decoy of the present invention may be fabricated in a manner to provide either a two-dimensional or a three-dimensional infrared and/or radar signature.

Referring now to the drawings, FIG. 1 shows a cross-sectional perspective view of a simulation decoy according to one embodiment of the present invention. In this embodiment, the simulation decoy 10 comprises a gas container vessel 11 whose lower portion defines a gas enclosure space 12 filled with a compressed oxygen-containing gas for support of combustion of the carbon-containing decoy fabric as hereinafter more fully described. The upper portion of the container 11 features a neck construction 13 in which is disposed a rupture disc 14 having an orifice 15 which is closed to gas communication with the exterior of the container by a rupture pin 16. Joined to the rupture pin 16 is a collapsed spherical balloon-like envelope 19 formed of fabric comprising a woven carbon fiber fabric in a matrix with reinforcing of "pre-ox" carbon fibers. The balloon-like envelope 19 is secured at its upper extremity to the rupture pin 16 and at its lower end to the outer surface of the neck of container 11, by means of the circumferentially applied adhesive joint 17, 18.

Figure 2:
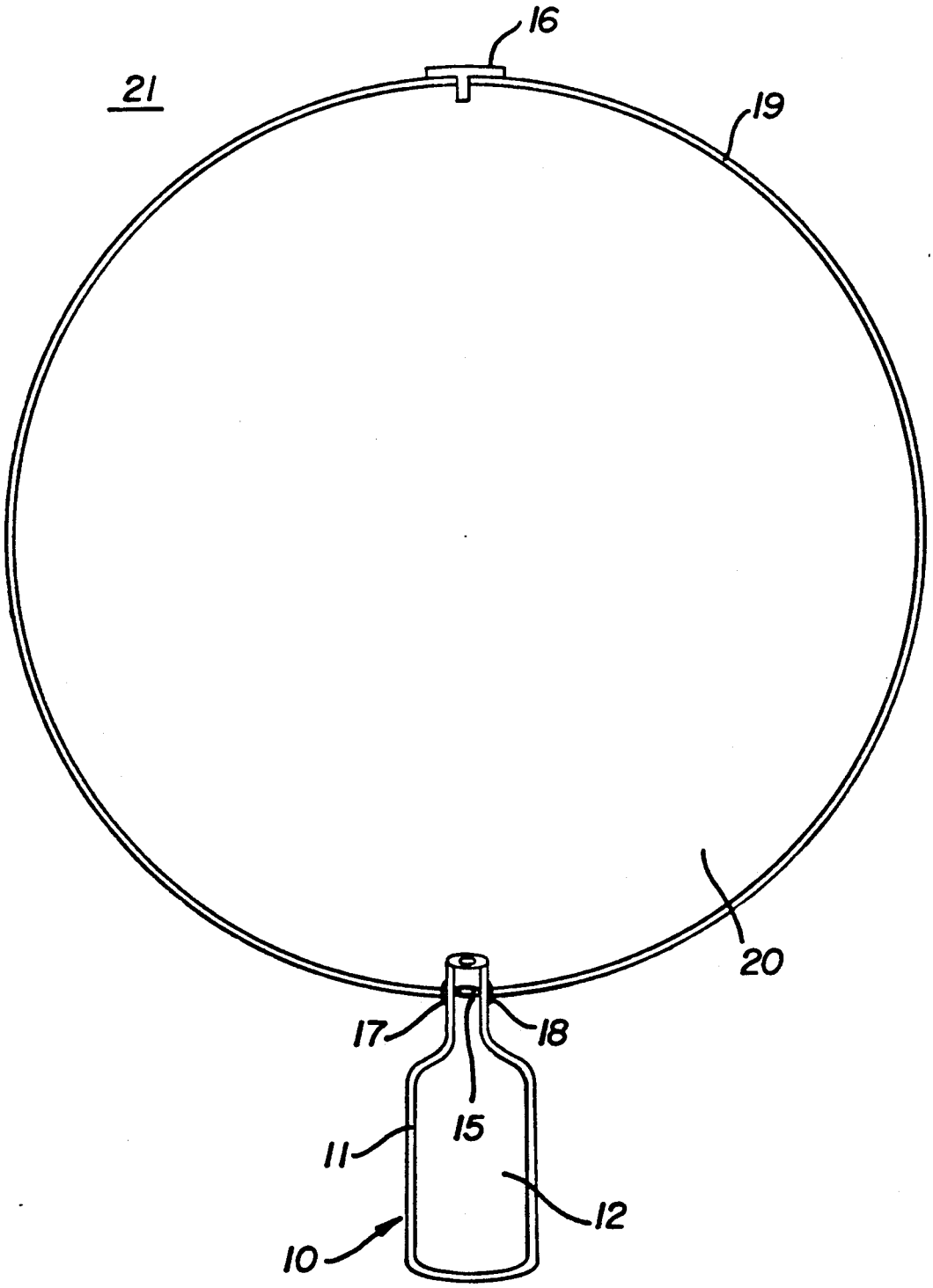
FIG. 2 shows the simulation decoy of FIG. 1, in an inflated state.

In operation, the decoy 10 is ejected or launched from suitable launching means, as for example from a conventional rocket launcher of an aircraft. The impact of launching (or alternatively, if the decoy is launched at high altitude, by operation of pressure differential between the interior of the container and the exterior atmosphere) results in rupture of the rupture disc 14 and release of the rupture pin 16 from the orifice 15 of the rupture disc. As a result of such rupture, the gas, at a pressure in the container 11 sufficient to inflate the balloon-like envelope 19, flows into the interior of the envelope 19 and inflates same to the configuration shown in FIG. 2. In FIG. 2, all parts and elements are numbered correspondingly with respect to the same parts in FIG. 1. The pressure differential between the interior 20 of the carbon fabric envelope 19 and the ambient pressure conditions of the external environment 21 is selected to provide for complete inflation of the envelope 19. The envelope 19 is designed with sufficient porosity to provide for diffusion and/or slow convection of gas outwardly through the fabric envelope to provide an oxygen-containing gas (if none is present in the exterior environment 21) at the envelope's exterior surface to support combustion of the envelope at a predetermined controllable sustained rate.

The composition of the gas contained in container 11 may be varied to provide a relatively faster or relatively slower rate of burning of the envelope 19 as may be desired or necessary in a given application. For example, it may be to advantage to employ a hydrocarbonaceous vapor in the oxygen-containing gas, to accelerate the rate of burning of the envelope 19 which otherwise would occur in the absence of such hydrocarbonaceous constituent. Alternatively, dilutents, such as helium, argon, nitrogen, or xenon may be employed to produce a relatively slower rate of burning to prolong the combustion life of the decoy. In this respect, it may be of advantage to utilize helium as a constituent gas in the envelope interior space 20, to provide for buoyancy of the decoy and positioning of same in a relatively stable locus in the atmosphere.

In summary, the character of the contained gas may be varied to increase or decrease the rate of combustion, which also may be varied by the thickness and woven or non-woven character of the envelope 19, as well as the envelope's specific composition. Further, the weight of the container 11 may be varied to produce a greater or lesser rate of descent when the decoy is launched in the atmosphere.

Figure 3:
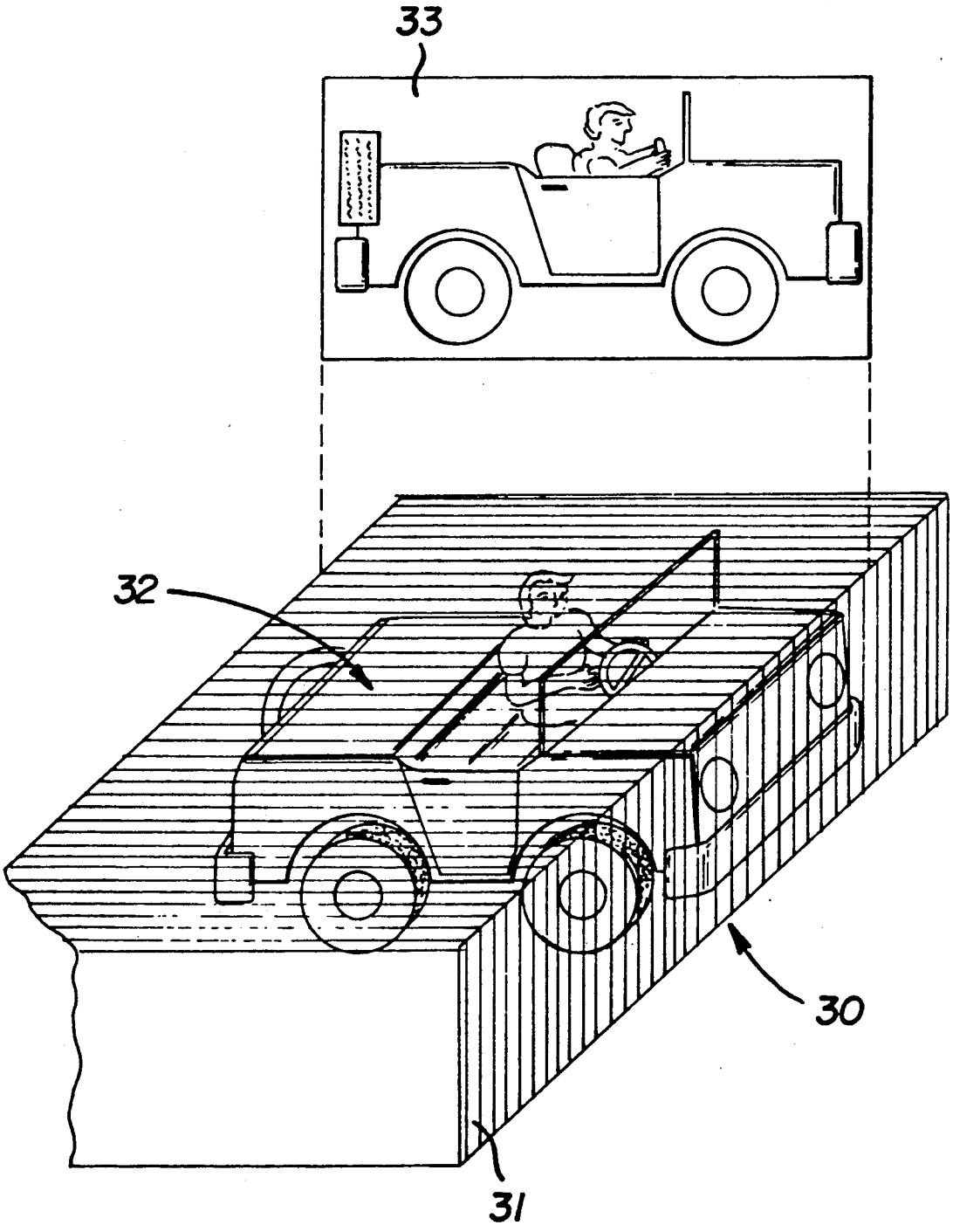
FIG. 3 is a perspective view of a laminated display body, which is activatable to provide an infrared simulation of a Jeep vehicle.

FIG. 3 shows a three-dimensional display body 30, which is composed of various sequential laminae 31, of which ply 33 is shown in greater detail to indicate the infrared signature (two-dimensional on the respective plies) of a simulated vehicle (Jeep) 32, which is provided (in three dimensions) by the laminated body. Thus, each ply of the laminate is provided with a coating of combustible carbon in the shape of a longitudinal cross-section of the Jeep 32, with the combustibility of the carbon being varied, as e.g. by provision of greater or lesser surface area in the carbon signature "picture" to provide thermal differentials across the plane of the picture, in order to simulate the temperature differentials which would be encountered by thermal sensing using infrared means of an actual Jeep vehicle (i.e., with hot spots being provided in the engine, coolant system, and exhaust train, so as to mimic exactly the infrared thermogram which would be generated by sensing an actual operating vehicle, including the thermographic characteristics of a human driver and any other occupants of such vehicle). Accordingly, when the display body 30 is actuated by igniting and combusting the combustible carbon-containing "picture," the burning display body will provide an accurate depiction of a vehicle and its driver. The combustible carbon may be ignited as in the prior embodiment by forming the signature picture of carbon fibers or particles in a matrix comprising a binder fiber reinforcing component wherein the carbon fibers or particles are coated with a metallic oxidation catalyst which initiates ignition upon exposure of the display body 30 to the ambient atmosphere.

Figure 4:
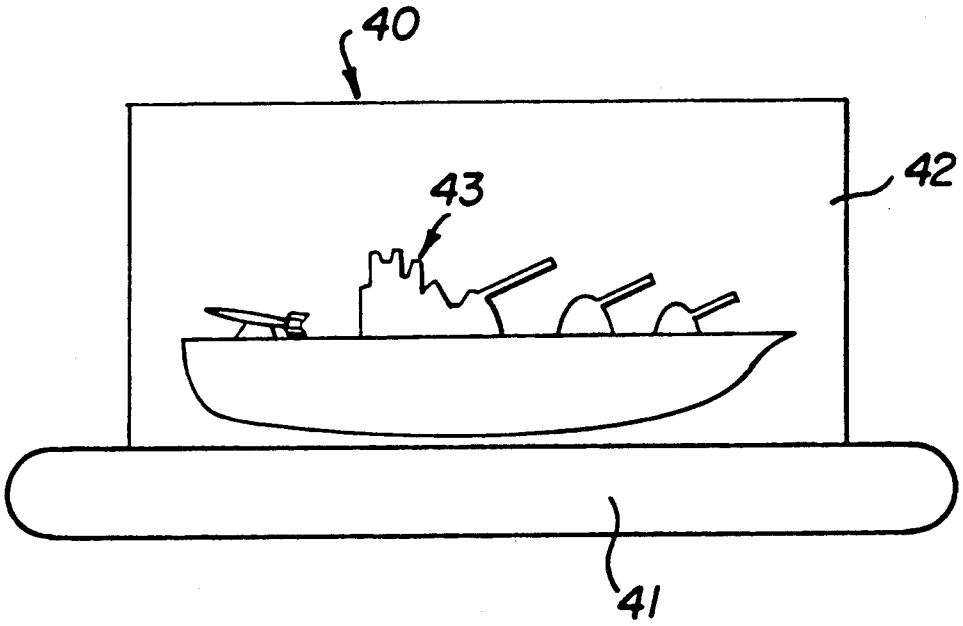
FIG. 4 is a two-dimensional display body providing a radar and infrared signature of a sea vessel.

FIG. 4 is a further embodiment of the invention, wherein a signature picture of a ship 43 is depicted on a planar display board 42 and the display body is mounted on pontoon members 41 to provide an assembly 40 which is capable of being floated in water to provide a signature detectable by radar and infrared scanning means. The display picture of the ship 43 again may be comprised of a fabric of the appropriate outline shape mounted on the display board, with the fabric comprising activated carbon fibers of high surface area coated with a metallic oxidation catalyst as a means to initiate ignition and combustion of the carbon fibers and including metal plated carbon fibers, to provide a radar and infrared signature for the decoy assembly.

Although the means disclosed in connection with the above-discussed preferred embodiments to initiate ignition and combustion of the carbon component of the fabric has included a metallic oxidation catalyst coating on the carbon fibers or particles, it will be appreciated that other means may be employed to initiate ignition and combustion of the carbon constituent, such as direct blow-torch or flame-thrower application of heat to the display body, or the provision of strongly exothermic chemical reaction means to provide localized heat input to the carbon particle or carbon fiber display, etc. In like manner, various geometries and configurations of the display will suggest themselves to those skilled in the art. Accordingly, all such modifications and variants of the invention are fully intended as being within the scope of the present invention.

The specific metal-coated fibers used in the practice of the present invention are characterized by the presence of a layer of CoW or NiW alloy interposed between the core of the fiber and the outer metallic layer of said metal coated fiber. Use of these fibers allow the claimed invention to demonstrate enhanced high temperature properties over decoys containing metal-coated fibers of the prior art since these alloy-coated fibers are less susceptible to deterioration under elevated temperature. Evidence of this resistance to deterioration under high temperatures is presented in the Examples contained herein.

A description of these metal-coated fibers and their preparation are set forth below.

The core fibers of the metal-coated fibers include carbon, graphite and mixtures of such fibers.

If a batch process is to be used in their production, it is convenient to use long cut sections of fiber tow (e.g. about 40 inches in length) tow and a glass weight placed halfway along the tow. The tow is then lowered into suitable vessels, e.g., 1 liter graduate cylinders containing the various baths described hereinafter, to provide that the weight rests on the bottom of the cylinder. In this way the fibers in the tows remain aligned.

Figure 5:
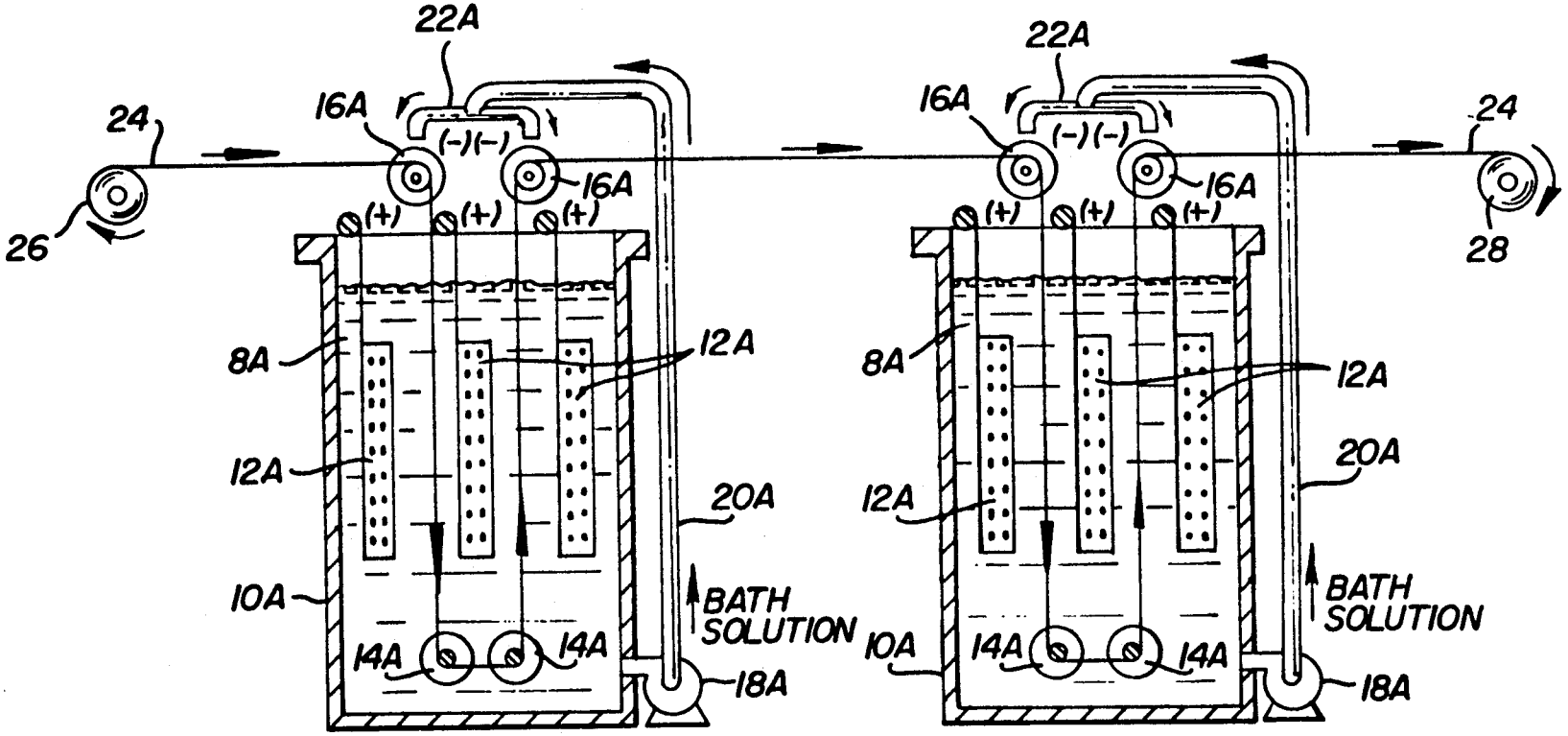
FIG. 5 shows an apparatus which may be utilized in the production of the specific metal-coated fibers employed in the present invention.

If a continuous process is to be used for their production, it may be convenient to operate in the fashion described in U.S. Pat. No. 4,609,449 which will hereinafter be described in reference to FIG. 5.

Electrolytic bath solution 8A is maintained in tank 10A. Also included are cathode baskets 12A and idler rolls 14A near the bottom of tank 10A. Two electrical contact rollers 16A are located above the tank. Tow 24 is pulled by means not shown off feed roll 26, over first contact roller 16A down into the bath under idler rollers 14A, up through the bath and over second contact roller 16A. By way of illustration, the immersed tow length may be about 6 feet. Optional, but very much preferred, is a simple recycle loop comprising pump 18A, conduit 20A, and feed head 22A. This permits recirculating the electroplating solution at a large flow rate, e.g. 2-3 gallons/min. and pumping it onto contact rollers 16A. Discharged just above the rollers, the sections of tow 24 leaving the plating solution are totally bathed, thus cooling them. At the high current carried by the tow, in $I^2R$ heat generated in some cases might destroy them before it reaches or after it leaves the bath surface without such cooling. The flow of the electrolyte overcomes anisotropy. Of course, more than one plating bath to effect electrodeposition of the alloy can be used in series.

Various electroplating baths may be used to effect electrodeposition of the CoW or NiW on the fibers. Such solutions and processes using said solutions are disclosed in *Modern Electroplating*, Third Edition, Wiley - Interscience, New York, John Wiley & Sons, 1974. For example a solution for use in bath 10A contains:

| | |
|---|---|
| cobalt sulfate and/or cobalt chloride | (25-200 g/l) |
| sodium tungstate | (5-100 g/l) |
| citric acid or sodium potassium tartrate | (5-100 g/l) |

Optionally, the above solution may contain a wetting agent, such as sodium lauryl sulfate, and/or from 25-100 g/s of ammonium chloride. A preferred solution for bath 10A contains:

| | |
|---|---|
| cobalt sulfate | (50-75 g/l) |
| sodium tungstate | (15-25 g/l) |
| citric acid | (60-79 g/l) |
| pH adjusted to 4.0 with sodium hydroxide | |

The current density employed in the electrodeposition of the CoW or NiW alloy is generally maintained in the range of 15-120 mA/cm$^2$, preferably between 30-60 mA/cm$^2$ and most preferably about 30 mA/cm$^2$. The speed of tow 25 is maintained in the range of 0.1-25 ft/min, preferably 0.5-10 ft/min and most preferably from 2-5 ft/min. The voltage employed to maintain the desired current density range from about 5-30 volts.

The electrodeposition of the tungsten-containing alloy is maintained such that an alloy thickness is deposited which is sufficient to protect the fiber from the elevated-temperature degradation seen with uncoated fibers. This thickness generally varies from the minimum thickness which is detectable by scanning electron microscopy to about 0.3 micron. Expressed in another manner, this thickness can range from less than about 0.1 micron to about 0.3 micron. Preferably, the thickness of the alloy is no greater than 0.1 μm. Most preferably, the thickness of the alloy is about 0.1 micron.

Solutions and process conditions useful in the electrodeposition of the outer metallic layer on the alloy-coated fiber are well known in the electroplating art. Reference is again made to *Modern Electroplating*, supra. and U.S. Pat. No. 4,609,449, the contents of both sources being hereby incorporated by reference.

The metals useful in the outer layer of the claimed fibers may be any metal which may be electrodeposited and provides adequate radar reflection ability. Its identity is therefore not critical. Among those metals useful in this regard include copper, aluminum, lead, zinc, silver, gold, magnesium, tin, titanium, iron, nickel, or a mixture of any of the foregoing. Preferred are nickel and copper.

The electrodeposition of the outer metallic layer is maintained for a time sufficient to produce a coating thickness sufficient for the intended application of the metal-coated fiber product. For instance, if the fiber is to be incorporated into a metal matrix composite, the thickness of the outer metallic layer may vary from about 0.1 to about 5.0 microns. Preferably, said layer has a thickness of about 0.2 to about 3.0 microns. Most preferably, the thickness ranges from about 1.5 to about 3.0 microns. However, if the fiber is to be used in electrical applications such as in providing electromagnetic shielding properties to molded articles, the thickness of the outer metallic layer on the fibers should range only from about 0.1 to about 0.3 micron.

Filtration of the solution within the baths is preferably performed by in-line filters and is very desirable to keep all solutions free of an accumulation of broken fibers.

The fiber is also preferably passed through an optional rinse station, desirable to remove any excess electroplating solution "drag-through" which can influence the chemistry of succeeding baths. A suitable rinse station consists of a table over which the fiber runs, and a water spray directed downward onto this table. The force of the water spray and subsequent run-off the edges of the "table" help to spread the fiber.

It should be understood that the plating line may have multiple tanks for each type of electroplating, and different current densities may be used therein. For example, a low current may be used in the first tank of each plating type to minimize the risk of fiber burnout. The remaining tanks can be operated at higher currents to facilitate more rapid plating in any of this remaining tanks. Solution agitation, such as by pumping from a reservoir, and oscillation resulting from the use a fiber spreading device may be employed to permit the current to be increased without evidence of hydrogen evolution, a symptom of overvoltages in plating operations, demonstrating that such agitation results in more efficient plating.

After the fiber has been electroplated with the outer metallic layer plated to a sufficient extent, the fiber optionally but preferably is rinsed as described above and then dried, such as through the use of an air knife, heat gun or rotary drum drier. Preferably, a heat gun is attached to a heating chamber (not shown). The fiber is then spooled, either onto a spool with other tows or preferably individually into separate spools by a fiber winder (e.g., graphite fiber winders made by Leesona Corp., South Carolina) (not shown).

As shown in the Examples contained herein, the alloy-coated fibers of the present invention markedly decrease temperature-induced deterioration of carbon and graphite fibers within a metal matrix. While not wishing to be bound by any theories presented herein, Applicant believe that such alloys present a barrier which presents interdiffusion of the fiber and matrix materials. This barrier is further believed to comprise a carbide composition of the alloy and fiber since preliminary x-ray diffraction studies have shown $Co_3W_3C$ and $Co_6W_6C$ to be present at the interface of fibers coated with CoW alloy.

EXAMPLE 1

A nickel/graphite sample was prepared through the electrodeposition of a relatively heavy coating of nickel onto tows of polyacrylonitrile (PAN) fibers, which are marketed by Hercules under the designation AS4-3K. Application of this heavy electrodeposited coating allowed the simulation of a metal matrix composite. The electrodeposition was accomplished through the use of a plating bath of the following composition:

450 ml. of 3.07M concentrate Ni sulfamate
30 g/l of Boric Acid
0.5 g/l of Sodium Laurel Sulfate The bath was found to have a pH of 4.0. Electrodeposition was conducted at a bath temperature of 50° C. and through the application of −1.1 V (vs SCE).

The resulting samples were then cut into 5–7 sections, each about one (1) centimeter in length. The samples were then sequentially degreased in acetone, hexane, methanol, hexane, and acetone followed by ultrasonic degreasing in ethanol. The samples were then individually encapsulated in quartz ampules under a vacuum of $10^{-5}$ Pa. The samples (with the exception of a control) were then heat treated. Only samples obtained from a single electrodeposition were used in any given test. Different batches were not mixed, and one sample from each batch was left unannealed for comparison purposes. Annealing of a single batch (4–6 samples) was done at one time, with all samples being placed in the furnace at once. Samples were removed individually at the end of a specified time interval, which ranged from 9.2 minutes to 168 hours. After heat treatment, the samples were ground on silicon carbide paper through 2400 grit and polished with diamond paste through 0.25 82 m.

Measurement of fiber diameter and observation of the fibers were then performed using a JEOL JXA-840 electron probe x-ray microanalyzer and a Tracor-Northern image analyzer. Typically, 5–10 fibers were used to determine the average fiber diameter of a sample. A total of 32 measurements were made on each fiber. The averages for all the fibers were then averaged to give the average diameter for the entire group of fibers.

The average diameter of the control sample of fibers were found to be about 7.01. This figure, as well as those for fibers following the application of elevated temperatures is set forth below in Table I.

TABLE I

| Sample | Annealing Treatment | Average Diameter (μm) | # of Fiber Measured |
|---|---|---|---|
| Control | None | 7.01 ± 0.27 | 13 |
| 1 | 1100° C., 24 hr | 0.75 ± 0.31 | 3 |
| 2 | 800° C., 24 hr | 6.36 ± 0.28 | 6 |
| 3 | 600° C., 24 hr | 6.78 ± 0.15 | 8 |

It is apparent that annealing at from 600°–1100° altered the fiber morphology with the severity of the alteration varying directly with annealing temperature. At both 600° C. and 800° C., analysis with the scanning electron microscope did not reveal any morphological changes in the fibers while in Sample 2, nickel was shown to have entered the fiber itself.

EXAMPLE 2

In procedure of Example 1 was followed except that a layer of cobalt tungsten alloy (CoW) was electrodeposited on the PAN fibers prior to their receiving the nickel coating.

Electrodeposition was accomplished through the use of a bath having the following composition:

0.23 m/l (64.5 g/l) $CoSO_4 7H_2O$
0.057 m/l (66.0 g/l) $Na_2WO_4$-$2H_2O$
0.31 m/l (18.8 g/l) Citric Acid
pH 4 (adjusted with $NH_4OH$).

Pre-electrolysis of the solution was conducted at 1 m A/cm$^2$ for 48 hours to ensure purity of the solution. Electrodeposition of the CoW alloy was then conducted at about 22° C. and an applied current of 30 mA/cm$^2$. The resulting fibers had a tungsten content of about 24–27 wt %.

The average diameters of the fibers within the sample so produced is set forth in Table II below.

TABLE II

| Samples | Annealing Treatment | Average Diameters (μm) | # of Fibers Measured |
|---|---|---|---|
| 4 | 1100° C., 24 hr | 3.79 ± 0.86 | 21 |
| 5 | 800° C., 24 hr | 6.77 ± 0.17 | 5 |
| 6 | 800° C., 49 hr | 6.25 ± 0.39 | 4 |

TABLE II-continued

| Samples | Annealing Treatment | Average Diameters (μm) | # of Fibers Measured |
|---|---|---|---|
| 7 | 800° C., 168 hr | 6.24 ± 0.21 | 8 |

Through comparison with Samples 1-3, it can be seen that the alloy coating protected the fibers even after annealing at 800° C. for 24 hours.

EXAMPLE 3

The procedure of Example 2 was followed except that electrodeposition of the CoW alloy was conducted such that the resulting fibers were coated with a thinner layer of alloy (<0.5 wt. % W).

The average diameter of the fibers within the sample so produced is set forth in Table III below.

TABLE III

| Sample | Annealing Treatment | Average Diameter (μm) | # of Fibers Measured |
|---|---|---|---|
| 8 | 800° C., 25 hr | 6.65 ± 0.04 | 2 |

Fiber damage was observed after annealing at 800° C. for 24 hr, but the damage was not nearly as severe as for the fibers in the nickel matrix with no intervening CoW layer.

As used herein, "reflection of radar" denotes that at least a portion of the radar signal which contacts the claimed decoy is redirected. While substantially all of a radar signal may indeed be redirected upon contacting the claimed decoy, the degree of redirection will depend upon the concentration of metal-coated fibers within the decoy and the angle of incidence of said radar signal. The phrase is not to be interpreted therefore as requiring the redirection of substantially all or even the majority of said radar signal.

I claim:

1. A simulation decoy whose position and structural purport are determinable by both radar and infrared detection means, comprising:

(a) a multi-dimensional display body formed of a fabric containing combustible carbon in the form selected from fibers and particles, said combustible carbon being present in the fabric in an amount and with a surface area sufficient to permit sustained burning of said fabric for a predetermined time;

(b) means to initiate ignition of said combustible carbon in said multi-dimensional display body fabric for sustained burning of said display body, whereby said simulation decoy is activated for infrared detection; and (c) metal-coated fibers comprising a core and an outer metallic layer and having a layer selected from NiW and CoW alloy interposed between the core of the metal-coated fibers and outer metallic layer of said fibers, said metal-coated fibers being present in an amount sufficient to effect the reflection of radar contacting said decoy.

2. A simulation decoy according to claim 1, wherein said fabric contains additional metal-coated compositions in the form selected from carbon fibers, activated carbon particles, reinforcing binder fibers and mixtures thereof.

3. The decoy of claim 1 wherein the thickness of said alloy layer is less than or equal to about 0.3 micron.

4. The decoy of claim 1 wherein the thickness of said alloy layer ranges from about 0.1 to about 0.2 micron.

5. The decoy of claim 1 wherein the thickness of said alloy layer is about 0.1 micron.

6. The decoy of claim 1 wherein the thickness of said outer metal layer(s) ranges from about 0.1 to about 5.0 micron.

7. The decoy of claim 6 wherein the thickness is at least about 0.2 micron.

8. The decoy of claim 6 wherein the thickness is at least about 1.5 micron.

9. The decoy of Cla μm 1 wherein said core of said fibers comprises carbon.

10. The decoy of claim 1 wherein said outer metal layer of said fibers (c) is selected from copper, aluminum, lead, zinc, silver, gold, magnesium, tin, titanium, iron, nickel, and a mixture of any of the foregoing.

11. The decoy of claim 10 wherein said metal is selected from the group consisting of copper and nickel.

12. The decoy of claim 1, wherein said fabric containing combustible carbon in the form selected from activated carbon fibers and particles comprises a composite material selected from the group consisting of:

(a) activated carbon fibers having a BET surface area in the range of from about 250 to about 1,000 $m^2/g$, reinforced with a reinforcingly effective amount of a nonignitable binder fiber; and (b) particulate carbon of diameter in the range of from about 10 μm to about 500 μm, encapsulated in a matrix of non-ignitable binder fibers; and (c) mixtures of (a) and (b).

13. The decoy of claim 12, wherein the combustible activated carbon content in said composite material of said fabric is in the range of from about 50% to about 85% by weight, based on the weight of said composite material.

14. The decoy of claim 1, wherein said means to initiate ignition of said combustible carbon in said multi-dimensional display body fabric comprise a coating of metallic combustion catalyst on the surface of said combustible carbon, at a sufficient loading thereon to induce burning of said fabric at ambient temperature in the presence of oxygen.

15. The decoy of claim 14, wherein said metallic combustion catalyst comprises a metal selected from the group consisting of chromium, silver, copper, and iron.

16. The decoy of claim 15, wherein the loading of metallic combustion catalyst is at least ½% up to 5% by weight, based on the weight of the combustible carbon.

17. The decoy of claim 15, wherein said metallic combustion catalyst has been loaded on said combustible carbon by liquid phase deposition of a metal salt on said carbon from a salt solution of the metal, followed by thermal decomposition of the metal salt under reducing conditions to yield a metal coating on said carbon in a reduced pure metallic state.

18. The decoy of claim 1, wherein said fabric has a combustible carbon content of between 50% and 85% by weight, based on the weight of the fabric.

19. The decoy of claim 1, comprising a sufficient quantity of metal-coated fibers in said fabric to provide a radar signature detectable by radar detection means, wherein said multi-dimensional display body has a radar- and infrared-detection signature in a geometric shape depictive of a motive structure.

20. A simulated decoy according to claim 19, wherein said multi-dimensional display body depicts a two-dimensional vehicular structure.

21. A simulation decoy according to claim 19, wherein said multi-dimensional display body depicts a three-dimensional vehicular structure.

22. The decoy of claim 19, wherein said motive structure is selected from the group consisting of tanks, trucks, ships and aircraft.

23. A simulation decoy according to claim 1, wherein said multi-dimensional display body is in the form of a collapsed spherical body enclosed by said fabric, and wherein said means (b) to initiate ignition of said combustible carbon for sustained burning of said multi-dimensional display body comprise a container (i) in latent gas flow communication with the interior of said collapsed spherical body, (ii) closed by rupturable closure means to provide gas flow communication between said container and said interior of said collapsed spherical body, and (iii) containing a gas having an oxygen content of from about 20% to about 100% by volume, said means (b) further comprising a metallic combustion catalyst deposited on said combustible activated carbon in said fabric; whereby upon encountering differential conditions, said rupturable closure means are ruptured to initiate gas flow communication between said container and said interior of said collapsed spherical body to cause inflation of said collapsed spherical body to a fully inflated configuration, and the oxygen-containing gas introduced into the interior of the inflated spherical body provides a combustion support medium for sustained burning of said combustible carbon which is catalytically initiated by said metallic combustion catalyst upon contact of said combustible carbon with the oxygen-containing gas.

24. The decoy of claim 23, wherein the oxygen-containing gas comprises a mixture of oxygen and a second gas component selected from the group consisting of helium, nitrogen, argon, and xenon, and mixtures thereof.

25. The decoy of claim 23, wherein the oxygen-containing gas is a mixture of oxygen and helium, whereby said multi-dimensional display body may be inflated in the atmosphere at high altitude and maintained at such high altitude for an extended time.

26. A simulation decoy whose position and structural purport are determinable by radar and infrared detection means, comprising:

(a) a multi-dimensional display body formed of a fabric comprising metal-coated fibers of diameter in the range of from about 4 μm to about 40 μm and length in the range of from about 1 mm to about 30 mm, said metal-coated fibers comprising a core and an otuer metallic layer and having a layer selected from NiW and CoW alloy interposed between the core and outer metal layer of said fiber, and a composite material selected from the group consisting of: (i) combustible activated carbon fibers having a BET surface area in the range of from about 250 to about 1,000 $m^2/g$, reinforced with a reinforcingly effective amount of non-ignitable binder fibers; and (ii) particular combustible activated carbon of diameter in the range of from about 10 μm to about 500 μm encapsulated in a matrix of non-ignitable binder fibers, wherein said composite material comprises a metallic constituent as a metallic combustion catalyst to induce ignition and sustained combustion of said combustible activated carbon fibers (i) or particular convertible activated carbon (ii), and the combustible activated carbon fibers (i) or particulate carbon (ii) constitutes at least 50% by weight, of the composite material, based on the total weight of said composite material, whereby said multi-dimensional display body's combustible activated carbon fibers (i) or particulate combustible activated carbon (ii) may be ignited and combusted by contact of said multi-dimensional display body with oxygen at ambient temperature.

27. A simulation decoy according to claim 26, wherein said composite material comprises combustible activated carbon fibers (i) which are coated with said combustion catalyst at a loading of from about ½% to about 5% by weight, based on the weight of said combustible activated carbon fibers, and wherein said combustible activated carbon fibers comprise from about 10% to about 40% by weight of fibers having a length of from about 0.010 inch to about 0.250 inch, based on the weight of said composite material.

28. A simulation decoy according to claim 27, wherein said combustible activated carbon fibers are present in said composite material with a reinforcingly effective amount of a non-ignitable carbon binder fiber having a BET surface area of less than 250 $m^2/g$.

29. A simulation decoy according to claim 26, wherein said multi-dimensional display body is in the form of a laminate structure, wherein the laminae of said laminate are impregnated with said combustible activated carbon fibers (1) or particulate combustible activated carbon (ii) such that said multi-dimensional display body provides a three-dimensional infrared signature.

30. A simulation decoy according to claim 26 wherein said infrared signature is in the geometric shape of a motive structure selected from the group consisting of land-based vehicles, marine vehicles, and aircraft.

31. The decoy of of claim 26 wherein the thickness of said alloy layer is less than or equal to about 0.3 micron.

32. The decoy of claim 26 wherein the thickness of said alloy layer ranges from about 0.1 to about 0.2 micron.

33. The decoy of claim 26 wherein the thickness of said alloy layer is about 0.1 micron.

34. The decoy of claim 26 wherein the thickness of said outer metal layer(s) ranges from about 0.1 to about 5.0 micron.

35. The decoy of claim 34 wherein the thickness is at least about 0.2 micron.

36. The decoy of claim 34 wherein the thickness is at least about 1.5 microns.

37. The decoy of claim 34 wherein said core comprises carbon.

38. The decoy of claim 26 wherein said outer metal layer (c) is selected from copper, aluminum, lead, zinc, silver, gold, magnesium, tin, titanium, iron, nickel, and a mixture of any of the foregoing.

39. The decoy of claim 38 wherein said outer metal layer is selected from the group consisting of copper and nickel.

* * * * *